US010602910B2

(12) United States Patent
Gutkowski

(10) Patent No.: US 10,602,910 B2
(45) Date of Patent: Mar. 31, 2020

(54) MODULAR DISHWASHER RACK WITH INTERCHANGEABLE AND CUSTOMIZABLE BASKET INSERTS

(71) Applicants: BSH Home Appliances Corporation, Irvine, CA (US); BSH Hausgeräte GmbH, Munich (DE)

(72) Inventor: William Gutkowski, Costa Mesa, CA (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 28 days.

(21) Appl. No.: 15/939,330

(22) Filed: Mar. 29, 2018

(65) Prior Publication Data

US 2019/0298146 A1 Oct. 3, 2019

(51) Int. Cl.
*A47L 15/50* (2006.01)

(52) U.S. Cl.
CPC ..... *A47L 15/505* (2013.01); *A47L 15/502* (2013.01); *A47L 15/506* (2013.01); *A47L 15/507* (2013.01)

(58) Field of Classification Search
CPC .... A47L 15/505; A47L 15/502; A47L 15/506; A47L 15/507
See application file for complete search history.

(56) References Cited

U.S. PATENT DOCUMENTS 1,997,432 A * 4/1935 Replogle ..... F25D 25/02 211/153
2,006,385 A * 7/1935 Dikeman ..... F24C 15/16 126/339
2,065,116 A * 12/1936 Constantine ..... F25D 25/021 108/26
2,086,118 A * 7/1937 Chadwick ..... F25D 25/02 211/153
2,089,359 A * 8/1937 Goulooze ..... F25D 25/02 108/26
2,095,811 A * 10/1937 Goulooze ..... F25D 25/024 312/274
2,875,016 A * 2/1959 Fry ..... F24C 15/16 126/1 F
3,252,582 A 5/1966 Kesilman et al.
3,266,484 A * 8/1966 Carpenter ..... F24C 15/16 126/337 R
3,283,915 A 11/1966 Maslow
5,651,597 A * 7/1997 Oslin ..... F24C 15/16 108/102
6,148,813 A * 11/2000 Barnes ..... A47B 88/487 126/339

(Continued)

*Primary Examiner* — Ko H Chan
(74) *Attorney, Agent, or Firm* — Michael E. Tschupp; Andre Pallapies; Brandon G. Braun

(57) ABSTRACT

A modular washware rack for a dishwasher, including an open frame having an upper level support structure that is configured to accept at least one basket insert from above and support the at least one basket insert at an upper level, the open frame having a lower level support structure, the at least one basket insert being adjustable in height by lifting and removing the at least one basket insert from the upper level support structure of the open frame and then sliding the at least one basket insert along the lower level support structure to support the at least one basket at a lower level.

24 Claims, 17 Drawing Sheets

(56) References Cited

U.S. PATENT DOCUMENTS

| | | | | |
|---|---|---|---|---|
| 7,448,508 | B2 * | 11/2008 | Babucke | F24C 15/168 211/126.9 |
| 7,455,066 | B2 | 11/2008 | Feddema et al. | |
| 7,789,082 | B2 * | 9/2010 | Woon | F24C 15/16 126/337 A |
| 7,862,664 | B2 * | 1/2011 | Choi | A47L 15/502 134/201 |
| 7,878,344 | B2 * | 2/2011 | Martin | F24C 15/16 126/337 A |
| 8,163,103 | B2 | 4/2012 | Shin et al. | |
| 8,950,595 | B2 | 2/2015 | Ammon | |
| 9,119,493 | B2 | 9/2015 | Jeong | |
| 9,380,926 | B2 | 7/2016 | Zhou et al. | |
| 9,516,990 | B2 | 12/2016 | Graute et al. | |
| 9,763,556 | B2 | 9/2017 | Kaberg et al. | |
| 2015/0182104 | A1 | 7/2015 | Jeong et al. | |
| 2015/0245761 | A1 | 9/2015 | Zhou | |

* cited by examiner

MODULAR DISHWASHER RACK WITH INTERCHANGEABLE AND CUSTOMIZABLE BASKET INSERTS

FIELD OF THE INVENTION

The present disclosure relates generally to dishwasher appliances and to racks for holding dishware and cutlery for a dishwasher. More particularly, the present disclosure relates to a washware rack that has interchangeable and customizable basket inserts. The washware rack may be a third or top modular washware rack.

BACKGROUND OF THE INVENTION

In general, most domestic dishwashers include two dishware racks to support items to be washed such as dishware, glassware, kitchen utensils, pots, pans, and the like. Typically, the two dishware racks include an upper dishware rack positioned near a top portion of the dishwasher, and a lower dishware rack arranged below the upper dishware rack. The upper dishware rack is used to support glassware, utensils, and other small items, while the lower dishware rack is used to support larger items, such as dinner plates, large bowls, cooking sheets, and baking pans. The dishware racks are normally formed from several discrete lengths of wire, welded together and then covered with a rubber or a plastic coating. Further, the dishware racks are formed with a plurality of vertically projecting tines to support and organize the items placed on the dishware rack.

Moreover, the use of a third, top washware rack is known per se in household dishwasher appliances. Such a third, top washware rack is positioned immediately above a second or middle washware rack. The second, middle washware rack is in turn positioned above a first or bottom washware rack that normally holds larger items, such as large dinner plates, etc., as noted above, inside the dishwashing compartment.

However, the known third, top washware racks are limited in their capacity, flexibility, and versatility.

SUMMARY OF THE INVENTION

More specifically, the known third, top washware racks have a large plastic piece that forms the basket of the rack and that is fitted over and fixed onto a wire frame. The wire frame is thus substantially hidden from view to the user by the plastic insert. The bulky plastic insert results in a relatively small clearance or spacing between an upper surface of a deepest portion of the top washware rack and an inner surface of a top wall of the dishwashing compartment, thereby limiting what can be placed on the third washware rack. Moreover, the flexibility of what can be placed on the middle washware rack is often limited by the fixed depth of the third, top washware rack.

An apparatus consistent with the present disclosure is directed to a modular washware rack that increases the capacity, flexibility, and versatility of a dishwasher.

An apparatus consistent with the present disclosure is directed to a modular washware rack that has interchangeable and customizable basket inserts that allow the user/costumer to customize their dishwasher loading experience.

An apparatus consistent with the present disclosure is directed to a third, top modular washware rack that allows the user/consumer to lift and remove the basket inserts in order to adjust the height level of the basket inserts in the third, top rack, or allows the user/consumer to completely remove the basket inserts from the modular washware rack if desired to facilitate the unloading process. Accordingly, the user/consumer is able to customize their basket inserts for configuration and depth based on the items they choose to load into their dishwasher.

According to one aspect, the present disclosure provides a modular washware rack for a dishwasher, comprising: an open frame having an upper level support structure that is configured to accept at least one basket insert from above and support the at least one basket insert at an upper level, the open frame having a lower level support structure, the at least one basket insert being adjustable in height by lifting and removing the at least one basket insert from the upper level support structure of the open frame and then sliding the at least one basket insert along the lower level support structure to support the at least one basket at a lower level.

According to another aspect, the present disclosure provides a modular washware rack, wherein the open frame is divided by an intermediate frame member so as to define two basket insert receiving areas, and wherein the at least one basket insert comprises two basket inserts disposed in the two basket receiving areas, respectively.

According to another aspect, the two basket inserts are asymmetrical in outer shape.

According to another aspect, the two basket inserts are symmetrical in outer shape.

According to another aspect, the two basket insert receiving areas have different sizes so as to accept different sized basket inserts.

According to another aspect, a slidable lid is disposed on upper edges of the basket inserts and positionable over a corresponding one of the basket inserts and configured to hold items to be washed in place within the corresponding one of the basket inserts.

According to another aspect, the open frame is formed of a metal wire frame.

According to another aspect, the open frame is formed of a plastic frame.

According to another aspect, at least the lower level support structure comprises at least a pair of spaced apart rails.

According to another aspect, each one of the spaced apart rails includes a plastic insert disposed thereover.

According to another aspect, each of the upper level support structure and the lower level support structure comprises at least a pair of spaced apart rails.

According to another aspect, the at least one basket insert includes handles.

According to another aspect, the present disclosure provides a dishwasher, comprising: a dishwashing compartment having a loading opening; a door configured to close the loading opening; a bottom washware rack configured for movement out of and into the dishwashing compartment; a middle washware rack configured for movement out of and into the dishwashing compartment; and a top washware rack configured for movement out of and into the dishwashing compartment, wherein the top washware rack comprises an open frame having an upper level support structure that is configured to accept at least one basket insert from above and support the at least one basket insert at an upper level, the open frame having a lower level support structure, the at least one basket insert being adjustable in height by lifting and removing the at least one basket insert from the upper level support structure of the open frame and then sliding the at least one basket insert along the lower level support structure to support the at least one basket at a lower level.

According to another aspect, the present disclosure provides a dishwasher, wherein the open frame is divided by an intermediate frame member so as to define two basket insert receiving areas, and wherein the at least one basket insert comprises two basket inserts disposed in the two basket receiving areas, respectively.

According to another aspect, the two basket inserts are asymmetrical in outer shape.

According to another aspect, the two basket inserts are symmetrical in outer shape.

According to another aspect, the two basket insert receiving areas have different sizes so as to accept different sized basket inserts.

According to another aspect, a slidable lid is disposed on upper edges of the basket inserts and positionable over a corresponding one of the basket inserts and configured to hold items to be washed in place within the corresponding one of the basket inserts.

According to another aspect, the open frame is formed of a metal wire frame.

According to another aspect, the open frame is formed of a plastic frame.

According to another aspect, at least the lower level support structure comprises at least a pair of spaced apart rails.

According to another aspect, each of the upper level support structure and the lower level support structure comprises at least a pair of spaced apart rails.

According to another aspect, the present disclosure provides a dishwasher comprising a first, bottom washware rack, a second, middle washware rack, and a third, top washware rack, wherein the third, top washware rack comprises an open frame having an upper level support structure that is configured to accept at least one basket insert from above and support the at least one basket insert at an upper level, the open frame having a lower level support structure, the at least one basket insert being adjustable in height by lifting and removing the at least one basket insert from the upper level support structure of the open frame and then sliding the at least one basket insert along the lower level support structure to support the at least one basket at a lower level.

According to another aspect, the present disclosure provides a dishwasher, wherein the open frame is divided by an intermediate frame member so as to define two basket insert receiving areas, and wherein the at least one basket insert comprises two basket inserts disposed in the two basket receiving areas, respectively.

According to another aspect, the two basket inserts are asymmetrical in outer shape.

According to another aspect, the two basket inserts are symmetrical in outer shape.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as right, left, right side, left side, upper, lower, vertical, horizontal used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
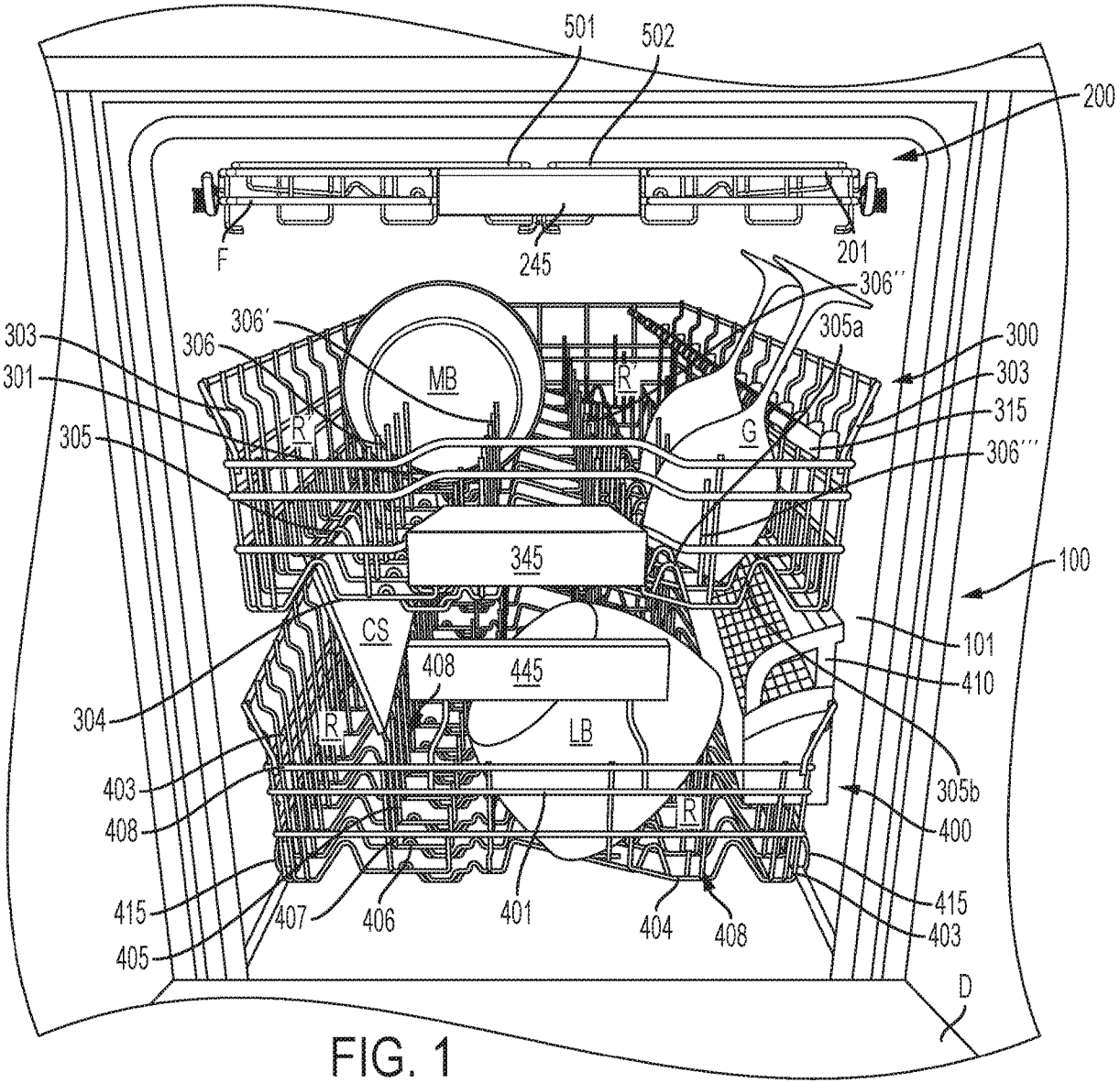
FIG. 1 is a front perspective view of a dishwasher appliance according to an exemplary embodiment consistent with the present disclosure, with the door open so as to reveal the dishwashing compartment including a third, top washware rack that is positioned immediately above the second or middle washware rack, which is in turn positioned above the first or bottom washware rack.

FIG. 1 is a front perspective view of a dishwasher appliance 100 according to an exemplary embodiment consistent with the present disclosure, with a door D (only a portion being shown) open so as to reveal the dishwashing compartment 101 having a loading opening and including a third, top modular washware rack 200 that is positioned immediately above a second or middle washware rack 300. The middle washware rack 300 is in turn positioned above a first or bottom washware rack 400.

Although not shown, as is known in the art, the dishwasher appliance 100 includes a tub, a pump and filter assembly, a heating element, one or more wash arms, and a drain hose. A detailed description of the suitable structure and operation of the dishwasher appliance 100 does not form part of the present disclosure, but can be found, for example, in U.S. Pat. Nos. 9,445,703 and 9,510,729 which are incorporated herein by reference.

More specifically, the first or bottom washware rack 400 is configured as a basket for holding larger plates, large bowls LB, pans, cookware such as a cooking sheet CS, etc. The bottom washware rack 400 includes front 401, rear (not shown), and opposing side walls 403 interconnected with a bottom portion 404 and formed by a plurality of wire shaped elements. The bottom washware rack 400 includes a plurality of tine members 405. The tine members 405 include a base member 406 from which extend a plurality of tines 407. The tines 407 form tine rows 408 to establish dish/utensil support regions R in the bottom washware rack 400. A utensil insert 410 may be included for holding utensils such as knives, forks, spoons, and other specialty items. At the bottom portion of the bottom washware rack 400 at the left and right sides thereof, rollers 415 configured to run on corresponding flanges or tracks on the inside wall of the dishwashing compartment 101 and also on an inside surface of the door D, as is conventional in the art. The bottom washware rack 400 can include a handle 445.

The second or middle washware rack 300 is positioned immediately above the bottom washware rack 400. The middle washware rack 300 is configured as a basket to hold medium sized dishes, bowls such as medium sized bowls MB, and glasses on one side, as well as stemmed wine glasses G on an opposite side as will be discussed in more detail below. The middle washware rack 300 includes front 301, rear 302, and opposing side walls 303 interconnected with a bottom portion 304 and formed by a plurality of wire shaped elements. The bottom portion 304 includes a plurality of forms 305 for holding items in place on the middle washware rack 300. A plurality of sets of retractable, rotatable or flip tines (306, 306', 306", 306'") may be included to customize the support regions R'. On the right hand side of the bottom portion 304 of the middle washware rack 300, the plurality of forms 305 include rows of forms 305*a* and 305*b* for supporting stemmed wine glasses G. In this regard, a plurality of stem supports or holders 315 extend from the right hand sidewall of the middle washware rack 300. Each of the stem holders 315 can be mounted to an individual base member or a common base member. The individual base members or common base member can be rotatably mounted to the sidewall of the middle washware rack 300 so that the stem holders 315 can be pivoted upwardly to a substantially vertical, stowed position when not in use. The middle washware rack 300 can include a handle 345. The details of the technology that may be used for the rotatable or flip tines 306-306'" and the stem holders 315 can be found, for example, in Bosch Dishwasher Models: SHX7PT55UC and SHX8PT55UC.

As noted above, the bottom washware rack 400 and the middle washware racks 300 are formed of wire shaped elements that are configured to have a basket shape. The wire shaped elements of the bottom and middle washware racks 400 and 300, respectively, may be formed of solid plastic, metal wire coated with plastic or rubber, or composite materials.

Figure 2:
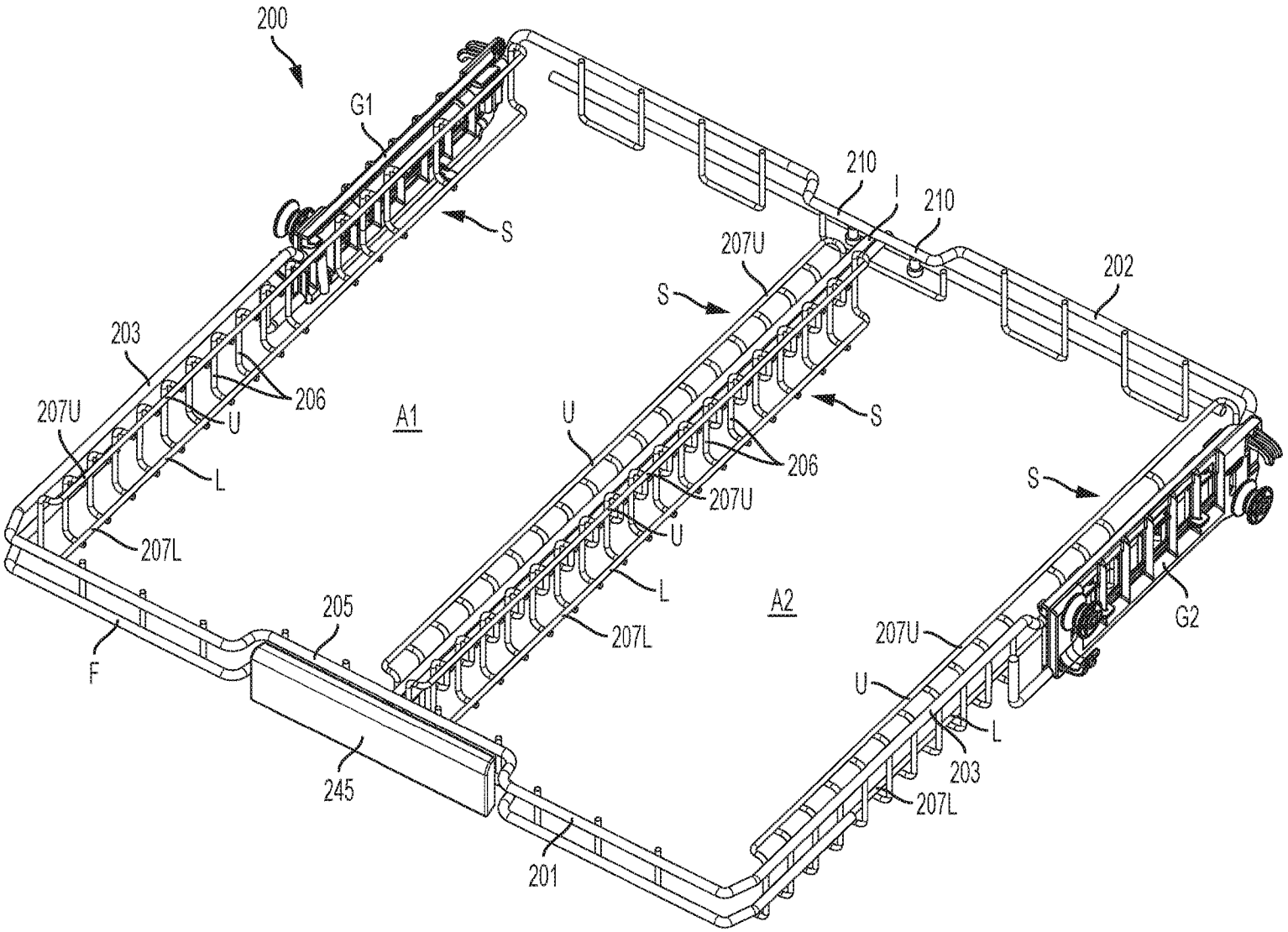
FIG. 2 is a top, front, perspective view of the third, top modular washware rack but without the basket inserts according to an exemplary embodiment consistent with the present disclosure.
Figure 7A:
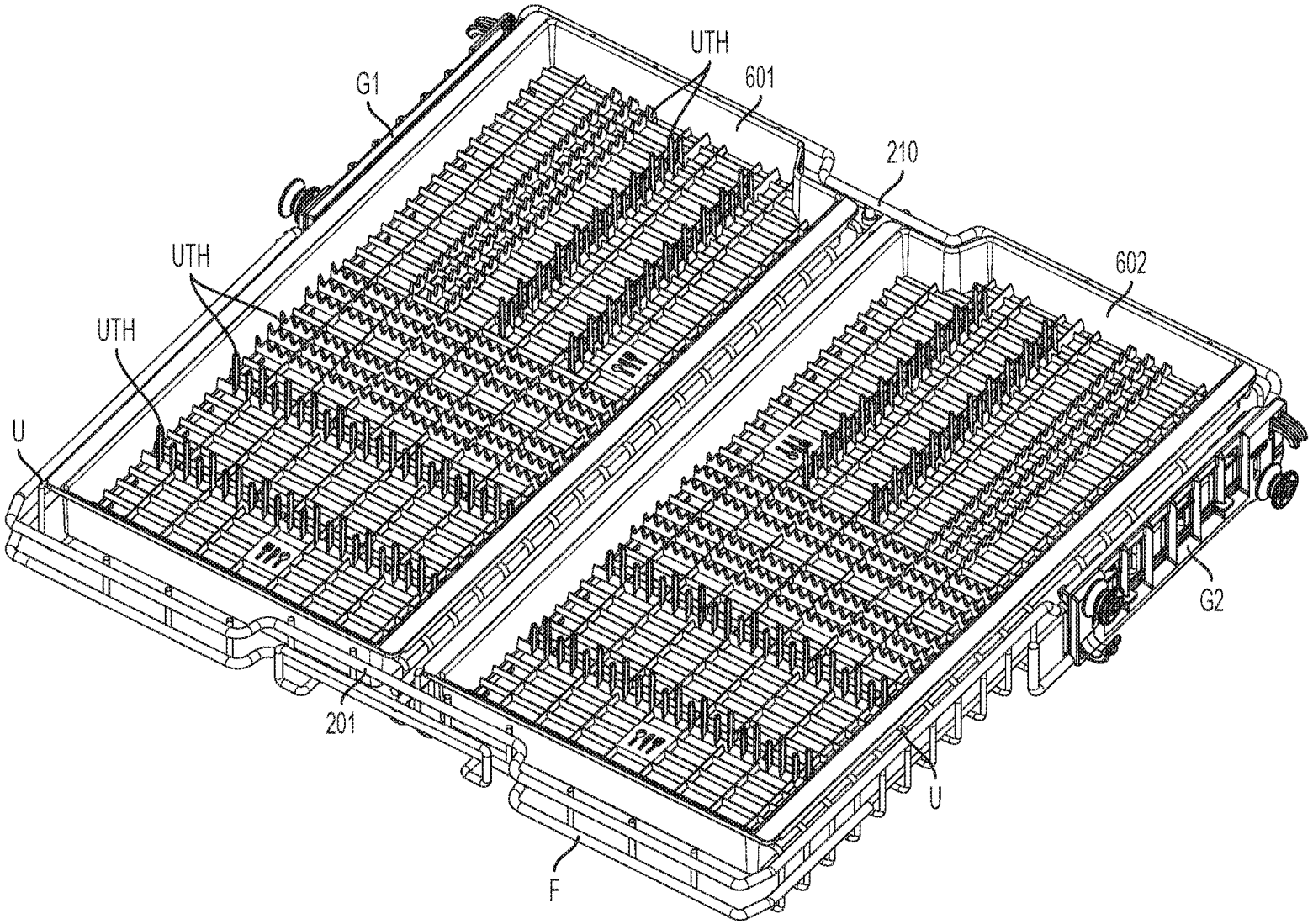
FIGS. 7A to 7E are various perspective views of a pair of plastic silverware basket inserts shown at the upper level and one of the plastic silverware basket inserts shown at the lower level in an asymmetrical configuration according to an exemplary embodiment consistent with the present disclosure.
Figure 7B:
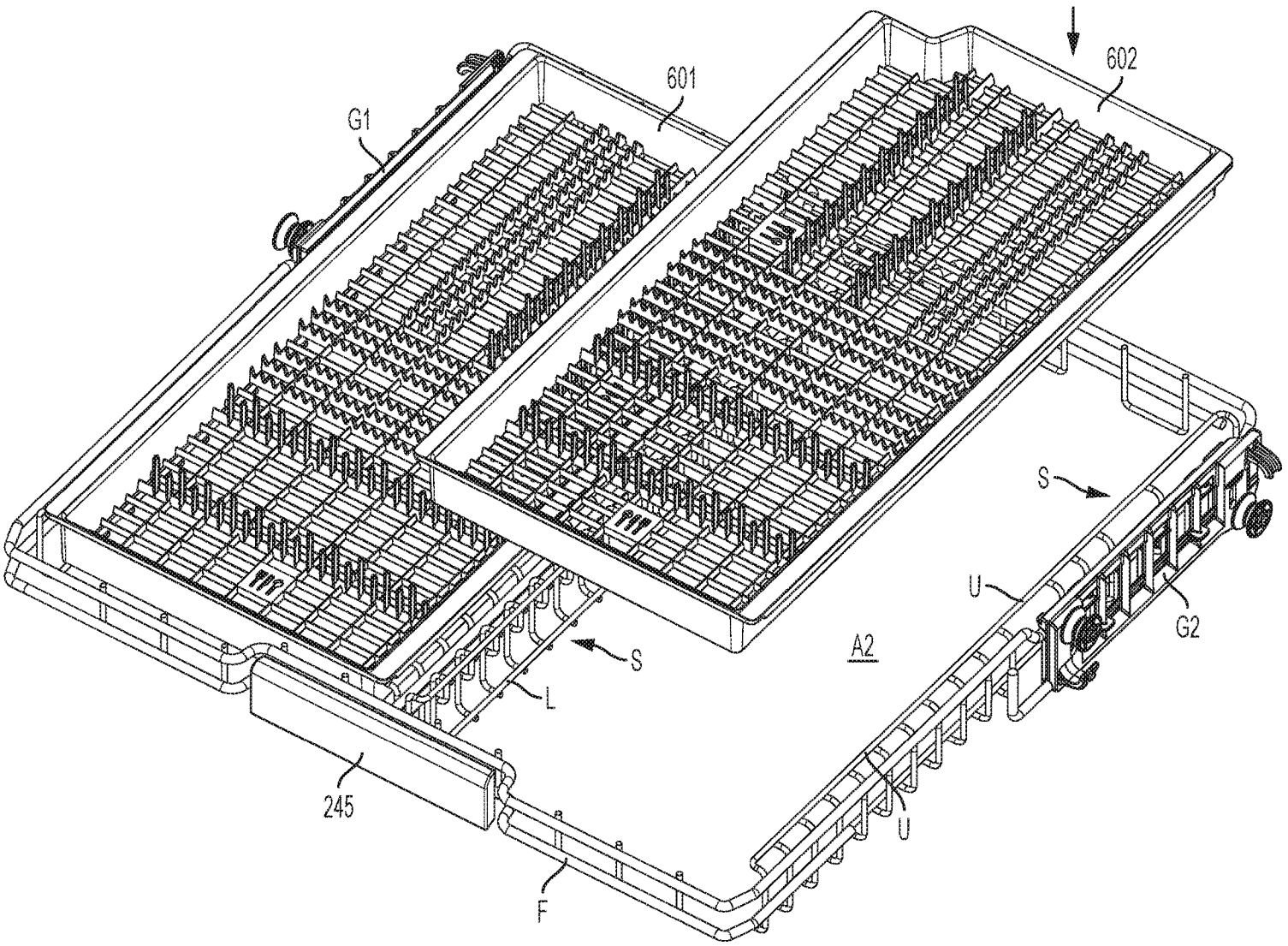
Figure 7C:
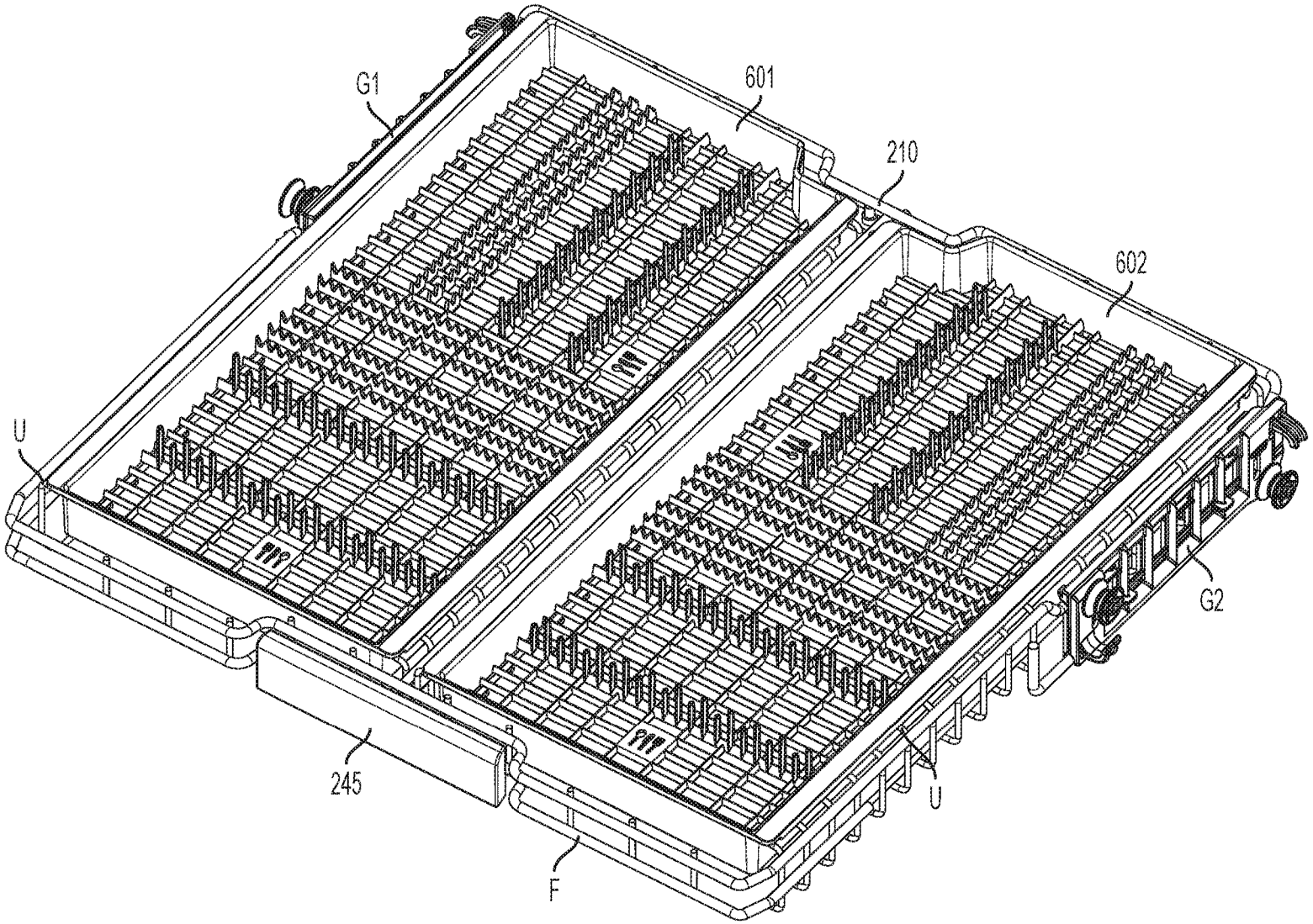
Figure 7D:
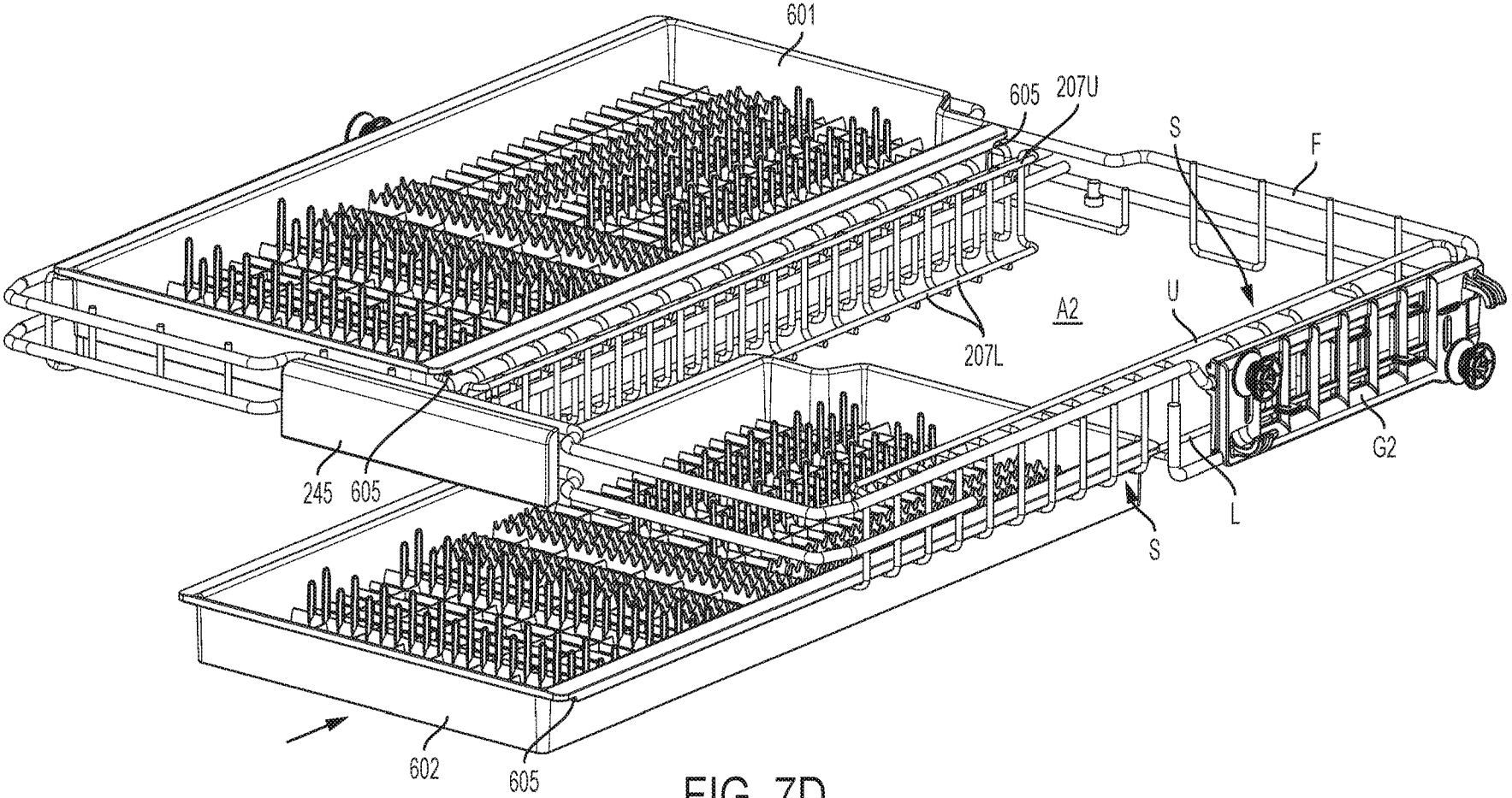
Figure 7E:
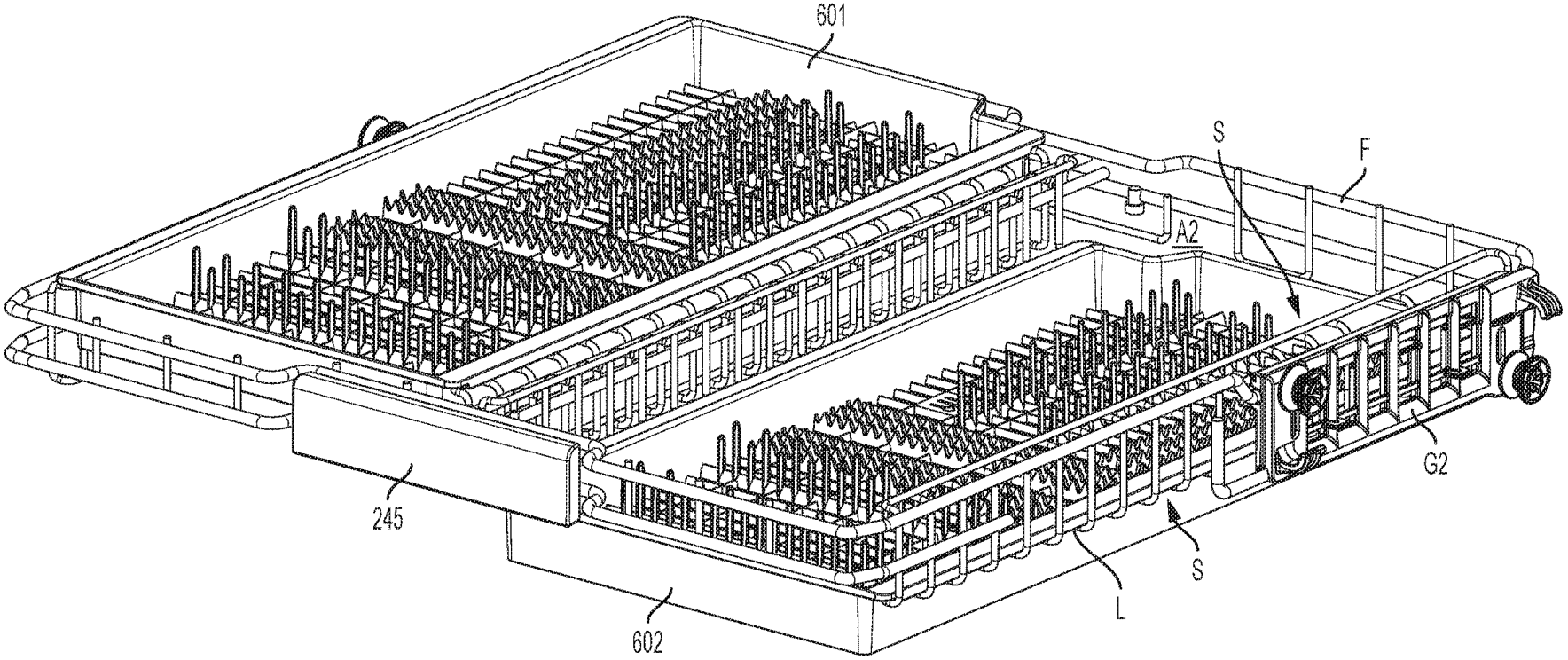
Figure 8:
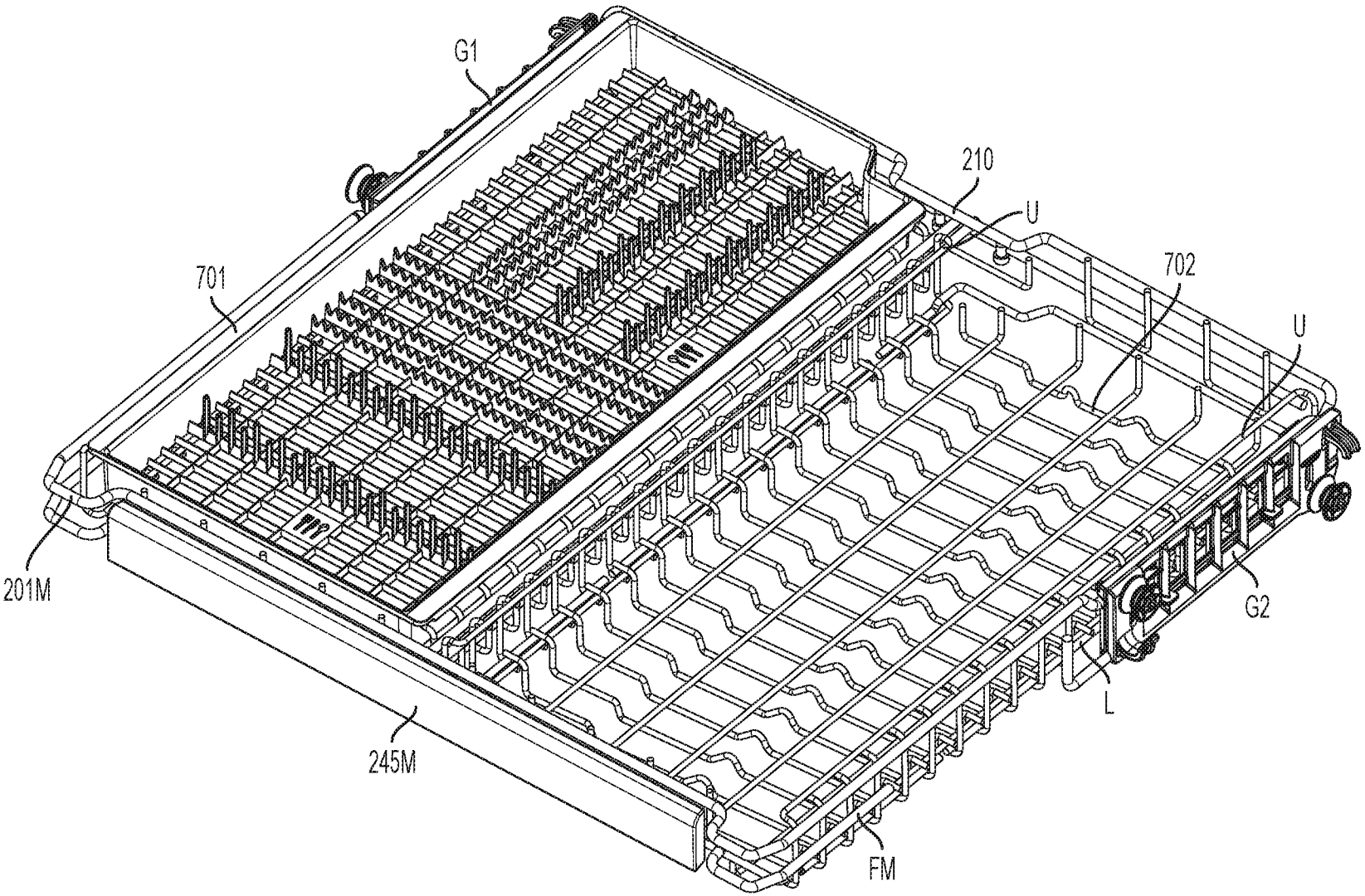
FIG. 8 is a top, front, perspective view of the third, top modular washware rack with a plastic silverware insert and a metal wire basket insert shown at a top level in an asymmetrical configuration according to an exemplary embodiment consistent with the present disclosure.
Figure 9:
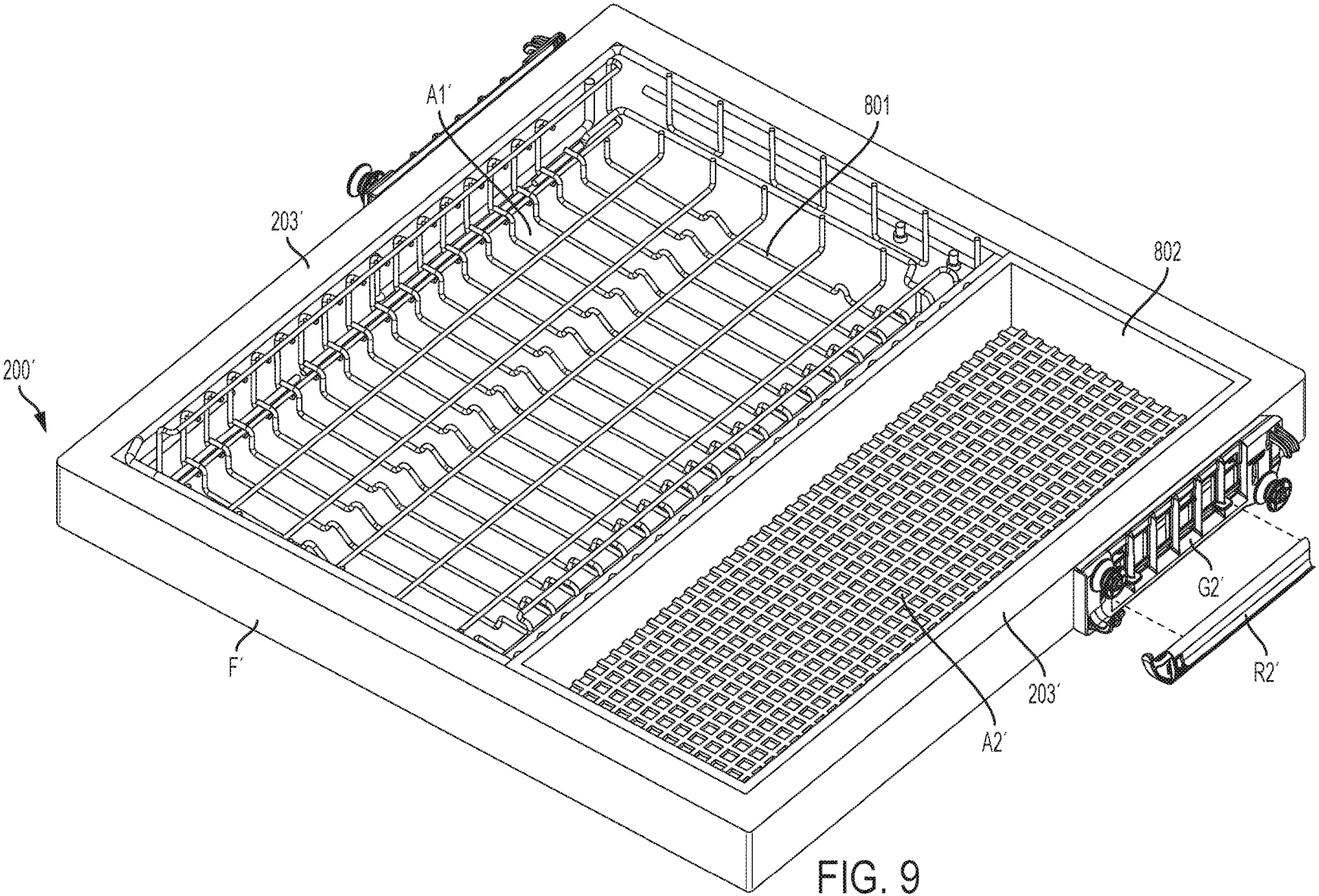
FIG. 9 is a top, front, perspective view of the third, top modular washware rack with a wire basket insert and a plastic tray insert of a plastic frame and also having two basket insert receiving areas with different sizes so as to accept different sized basket inserts according to an exemplary embodiment consistent with the present disclosure.

As shown in FIGS. 2-11C, the various embodiments of the third, top washware rack 200 are configured to hold cutlery and washware which is larger than cutlery such as, but not limited to, small dishes, bowls, cups, as well as cooking utensils. With reference to FIG. 2, the third, top washware rack 200 is configured as modular washware rack comprising a frame F and includes front 201, rear 202, and opposing side walls 203 formed by a plurality of wire shaped elements formed either entirely out of metal (such as stainless steel), or metal (such as carbon steel) dipped in, for example, a Nylon powder so that the wire is coated. The frame F can also be a combination of a wire frame covered with a plastic piece, or entirely out of plastic as shown in FIG. 9 and described in detail below. In general and as can be seen in FIG. 2, the frame F is configured as an open frame that is divided by an intermediate frame member I so as to define, for example but not limited to, two basket insert receiving areas A1 and A2. Thus, the frame F is hereinafter referred to using the term "frame" as well as "open frame" as is appropriate. The third, top washware rack 200 can include a form or recess 205 on the front wall 201 for mounting thereon a handle 245.

With reference to FIG. 2, both side walls 203 and both sides of the intermediate frame member I have basket insert support structures (generally identified as S) that define an upper level support structure at an upper level U and a lower level support structure at a lower level L within each basket insert receiving area A1 and A2 of the open frame F. The support structures S may comprise bent vertical wire portions 206 that extend into the basket insert receiving area A1 and A2 and support horizontal wire portions 207U and 207L that extend from front to back of the open frame F in the form of rails. The ends of the horizontal wire portions 207U and 207L may be connected together by a bent vertical wire portion 206 that extends therebetween, as shown in FIG. 2. As will be discussed in more detail below, the upper level basket insert support structures S allow the basket inserts to be disposed in the basket insert receiving area A1 and A2 from above and supported at their side edges at the upper level U of the frame F, whereas the lower level basket insert support structures S allow the basket inserts to be slid in and supported at their side edges at the lower level L of the frame F. While the upper level support structures S are shown as horizontal wire portions or rails 207U that extend from front to back of the open frame F, they can also simply extend a short distance and thereby provide support in each of the four corners (for example, see the embodiment of FIG. 11A) of the basket insert receiving areas A1 and A2 since the basket inserts are inserted from above and supported at their side edges at the upper level U. The lower level support structure S may comprise at least a pair of spaced apart rails formed by the horizontal wire portions 207L.

Also, as will be discussed in more detail below, the rear wall 202 may also include a recess or indent 210 which cooperates with a complementary portion at the rear of each the basket inserts such that they are asymmetrical and only fit in a corresponding one of the upper basket insert receiving areas A1 or A2 at the upper level U when inserted from above by the user/consumer. In this regard, note that the recess or indent 210 in the rear wall 202 is shown only at the upper level U of the upper basket insert receiving areas A1 or A2 in FIG. 2, so that the basket inserts can be slid into either area A1 or A2 at the lower level L. The indent 210 could also be provided at the lower level L of the rear wall 202, so that the left side basket could only be used on the left side or area A1 of the open frame F whether at the upper level U or the lower level L, and the right side basket could only be used on the right side or area A2 of the open frame F whether at the upper level U or the lower level L. Still further, alternatively or in addition, the form or recess 205 on the front wall 201 for mounting thereon the handle 245 could also be used to cooperate with a corresponding recess portion (not shown) at the front of both basket inserts for asymmetry.

As best shown in FIG. 2, the third, top washware rack 200 can be displaced in a forward direction and a rearward direction in each instance by way of roller guide systems G1 and G2 provided on the left and right sides, respectively, of the frame F for easier loading and unloading. Each of the roller guide systems G1 and G2 may be snapped onto the corresponding side walls 203 at a position closer to the rear of the frame F. Each of the roller guide systems G1 and G2 can engage with a corresponding telescopic rail assembly R1 and R2 mounted on the left and right sidewalls, respectively, of the dishwasher compartment 101 (see FIG. 1). The middle washware rack 300 can use a similar roller guide system/telescopic rail assembly as used with the third, top washware rack 200. The details of technology that may be used for the roller guide system/telescopic rail assembly for the middle washware rack 300 and third, top washware rack 200 can also be found, for example, in Bosch Dishwasher Models: SHX7PT55UC and SHX8PT55UC.

With reference to FIGS. 3A, 3B, 4, 5, and 6, a discussion will now be made of the basket inserts and, in particular, metal wire basket inserts having an asymmetrical configuration according to an exemplary embodiment consistent with the present disclosure. While two basket inserts are shown in the drawings and described throughout the disclosure, it is contemplated that a single basket insert could be used in which case the intermediate member I would be eliminated in the open frame F such that there is a single basket insert receiving area and the single basket insert can extend over the entire width of the open frame F. Likewise, more than two basket insert areas and two basket inserts are contemplated by the present disclosure, in which case multiple intermediate members I would be used to divide up the basket insert area into a plurality of areas A1, A2, . . . $A_n$, as needed.

Figure 3A:
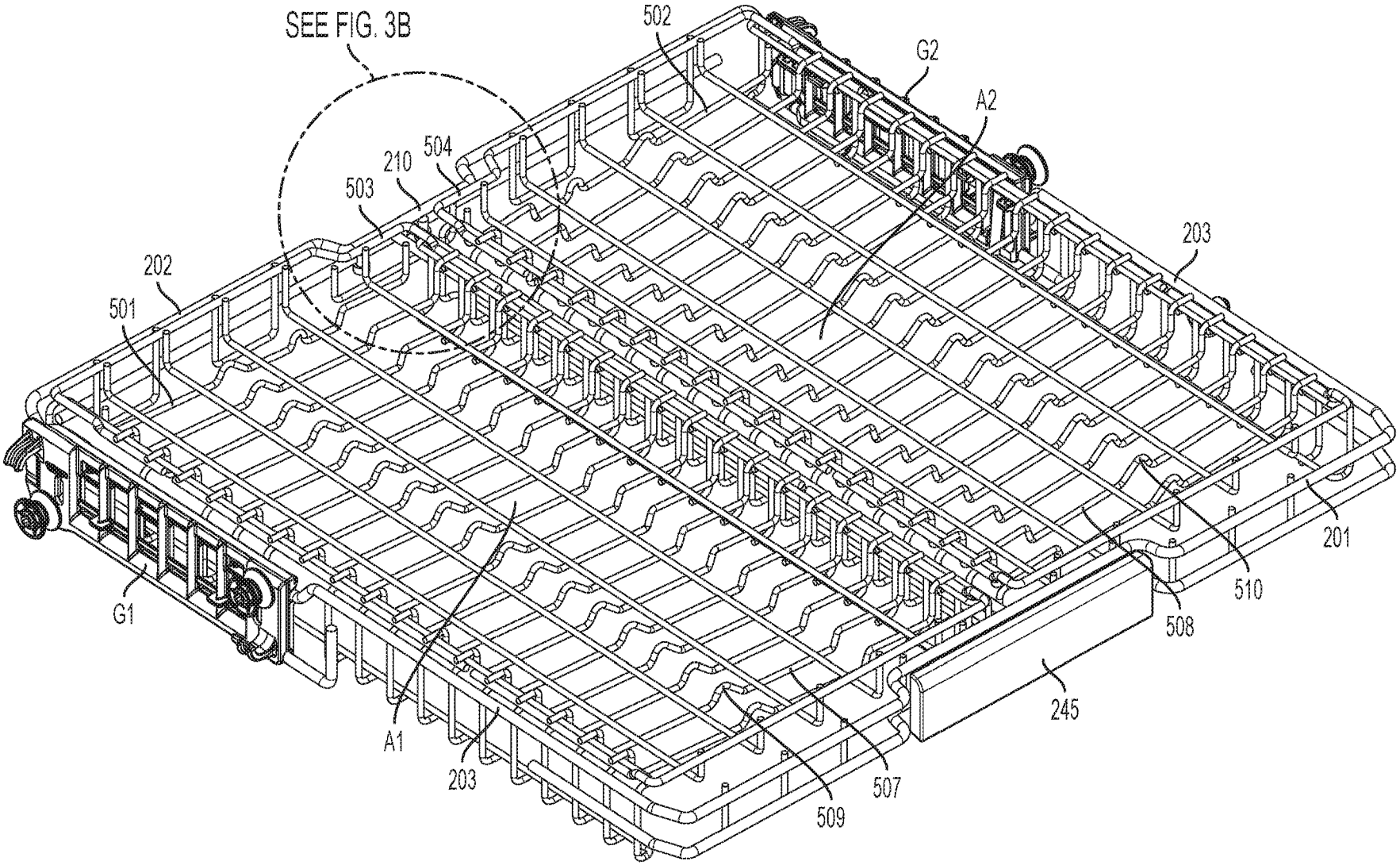
FIG. 3A is top, front, perspective view of the third, top modular washware rack with a pair of metal wire basket inserts shown at an upper level in an asymmetrical configuration according to an exemplary embodiment consistent with the present disclosure.
Figure 3B:
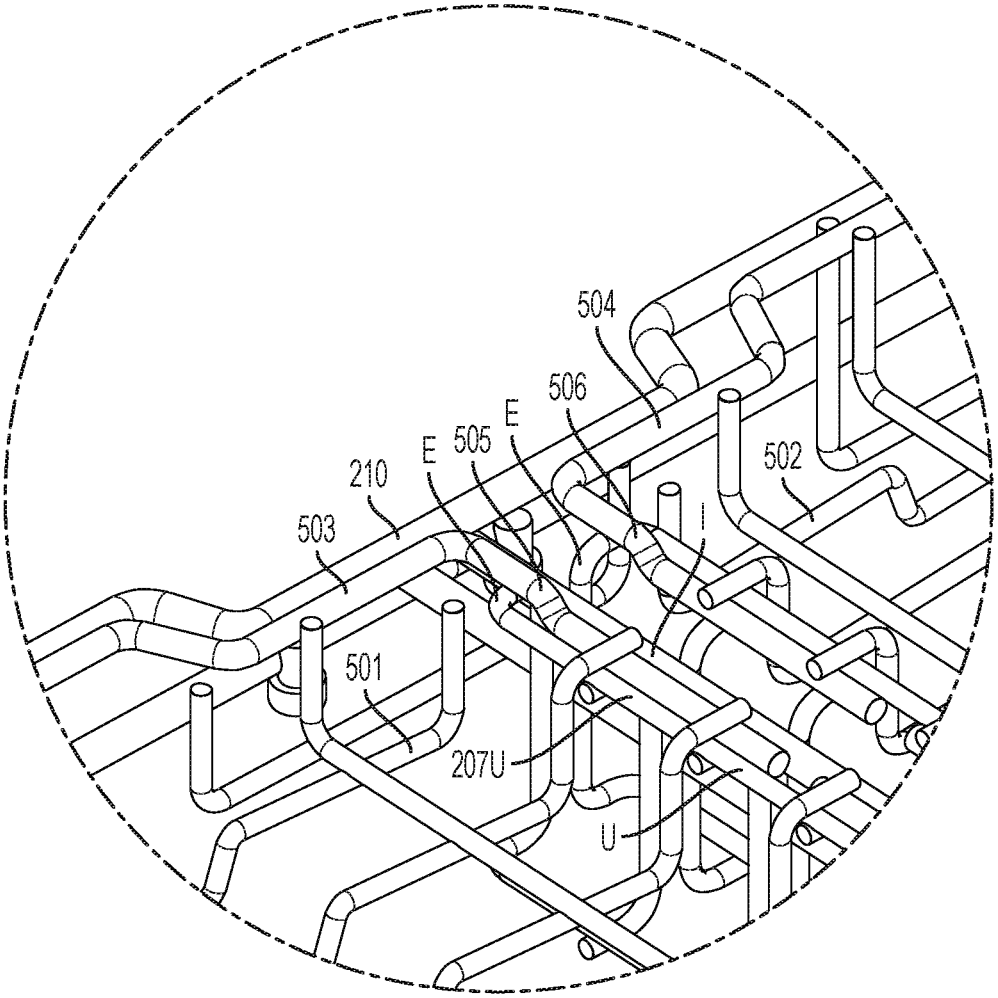
FIG. 3B is an enlarged view of a portion of FIG. 3A showing a locking feature of the metal wire basket inserts according to an exemplary embodiment consistent with the present disclosure.

As shown in FIGS. 3A and 3B, a pair of metal wire basket inserts 501 and 502 are shown in the basket receiving areas A1 and A2, respectively. The metal wire basket inserts 501 and 502 are formed by a plurality of wire shaped elements formed either entirely out of metal (such as stainless steel), or metal (such as carbon steel) dipped in, for example, a Nylon powder so that the wire is coated. The complementary portions for cooperating with the recess or indent 210 on the rear wall 202 of the open frame F are formed as recessed corner portions 503 and 504 at the rear of each the metal wire basket inserts 501 and 502, respectively, such that they are asymmetrical and only fit in a corresponding one of the upper basket insert receiving areas A1 or A2 at the upper level U when inserted from above by the user/consumer.

As shown in FIG. 3B, the metal wire basket inserts 501 and 502 further each include a locking feature 505 and 506, respectively. Using the metal wire basket insert 501 as an example, the locking feature 505 is formed as a slight bend/step at the front and rear of the metal wire basket insert 501 and configured to engage with end portions E of the horizontal wire portions 207U at the upper level U that are bent outward at right angles with respect to the horizontal wire portions 207U. The same locking feature 505 is also provided at the front and rear of the metal wire basket insert 501 on the left side thereof. Likewise, the metal wire basket insert 502 that is configured to be disposed in the basket receiving area A2 has the locking feature 506 at the front and rear on both sides thereof. Thus, each metal wire basket insert 501 and 502 has the slight bend/step at each of the four corners thereof, so that it can nest on the upper level basket insert support structures S and "lock" into place (see FIG. 3A). This prevents the metal wire basket inserts 501, 502 from sliding out when the user/consumer pulls out the third, top washware rack 200 from the dishwashing compartment 101 on telescopic rail assembly R1 and R2.

The bottom portions 507 and 508 of each of the metal wire basket inserts 501 and 502 can have a plurality of forms 509 and 510, respectively, arranged in one or more rows to support various types of washware in the third, top modular washware rack 200 as described above.

Figure 4:
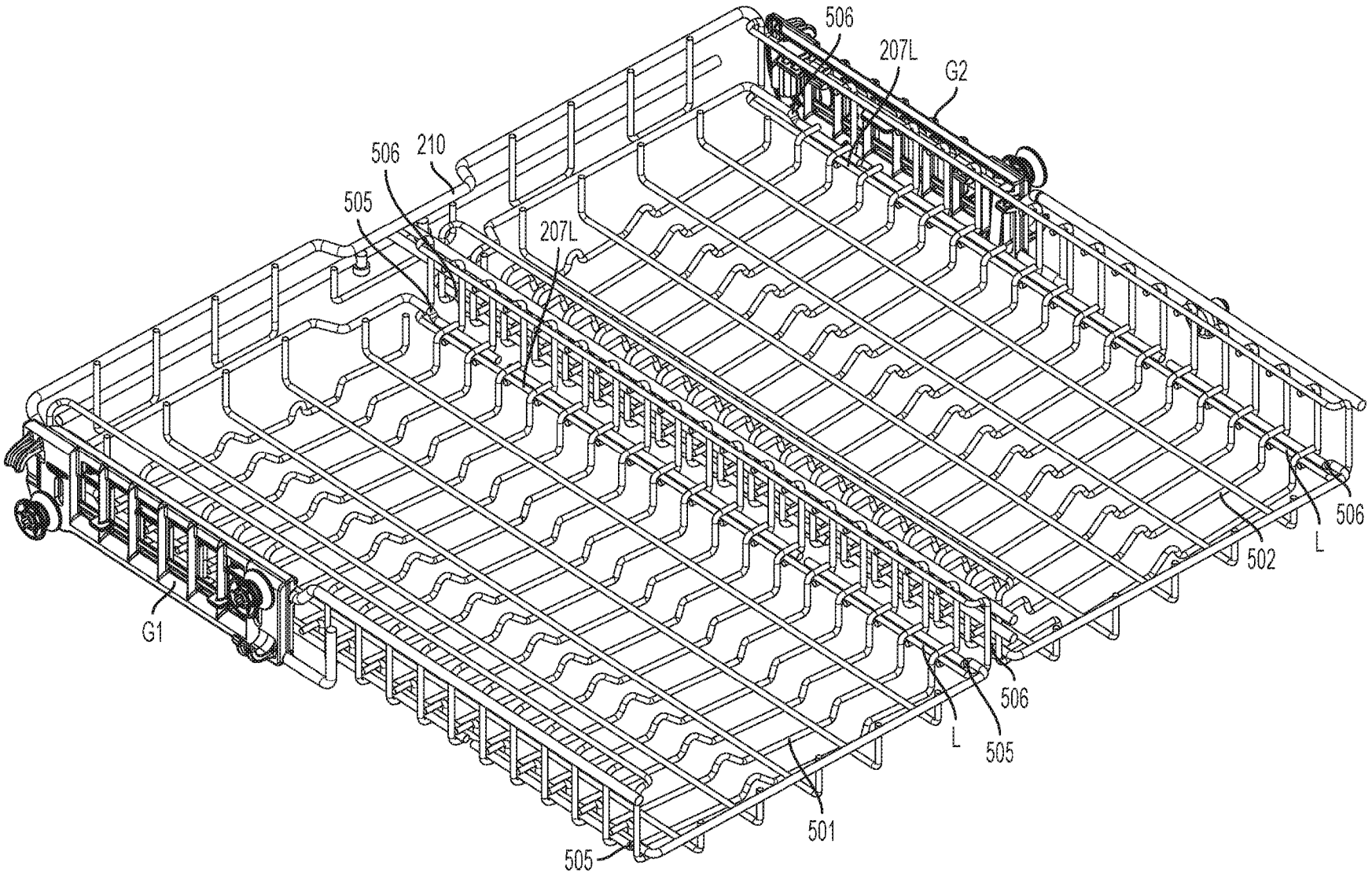
FIG. 4 is a is top, front, perspective view of the third, top modular washware rack with a pair of metal wire basket inserts similar to FIG. 3A but showing the metal wire basket inserts locked into position at a lower level according to an exemplary embodiment consistent with the present disclosure.

FIG. 4 shows the metal wire basket inserts 501 and 502 disposed at a lower level L (note that in FIG. 4 the front of the open frame F including the handle 245 has been removed for ease of understanding). More specifically, the lower level basket insert support structures S allow the metal wire basket inserts 501 and 502 to be slid in and supported at their side edges at the lower level L of the frame F on the horizontal wire portions or rails 207L. As is the case at the upper level, the slight bend/step at each of the four corners (see locking feature 505 and 506) of the metal wire basket inserts 501 and 502 allow them to nest on the lower level basket insert support structures S at the lower level L and "lock" into place (see FIG. 4). This prevents the metal wire basket inserts 501, 502 from sliding out from the lower level L when the user/consumer pulls out the third, top washware rack 200.

Figure 5:
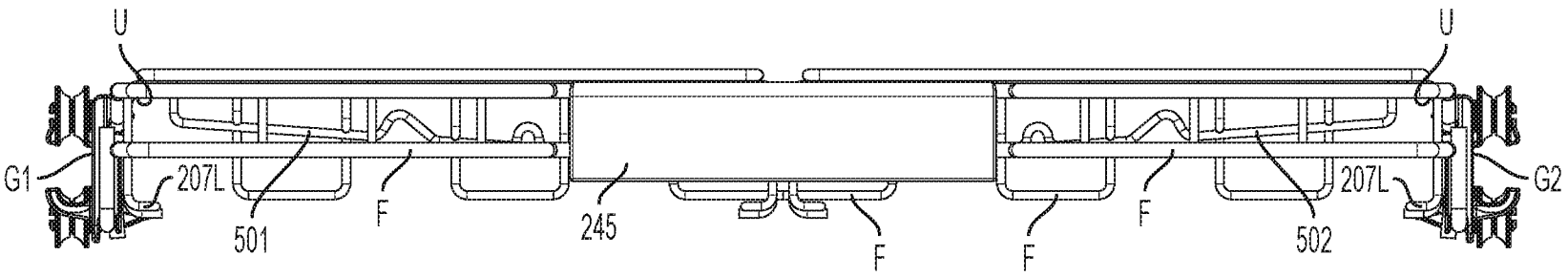
FIG. 5 is a front view of the third, top modular washware rack with the pair of metal wire basket inserts of FIG. 3A disposed at an upper level according to an exemplary embodiment consistent with the present disclosure.

FIG. 5 is a front view of the third, top washware rack 200 with the pair of metal wire basket inserts 501 and 502 of FIG. 3A disposed at the upper level U according to an exemplary embodiment consistent with the present disclosure. When positioned at the upper level U, the metal wire basket inserts 501 and 502 are inserted from above by the user/consumer into the basket receiving areas A1 and A2, respectively, and rest on top of the horizontal wire portions 207U of the upper level basket insert support structures S in their "locked-in" position. By placing the metal wire basket inserts 501 and 502 at the upper level U of the modular third, top washware rack 200, the user/consumer can provide more clearance for taller items such as stemmed wine glasses G disposed on the middle washware rack 300 (see FIG. 1).

Figure 6:
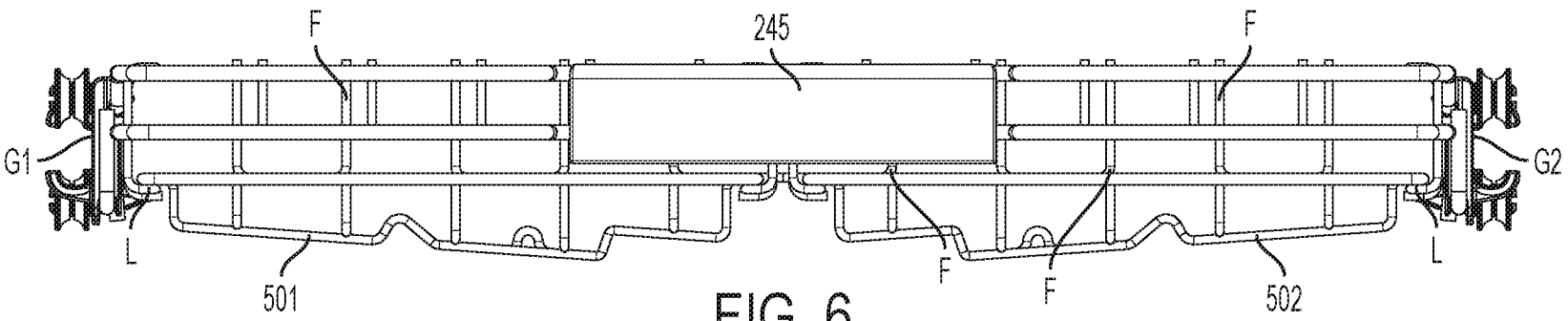
FIG. 6 is a front view of the third, top modular washware rack with the pair of metal wire basket inserts of FIG. 4 disposed at a lower level according to an exemplary embodiment consistent with the present disclosure.

On the other hand, FIG. 6 is a front view of the third, top washware rack 200 with the pair of metal wire basket inserts 501 and 502 of FIG. 4 disposed at the lower level L according to an exemplary embodiment consistent with the present disclosure. When positioned at the lower level L, the metal wire basket inserts 501 and 502 are first lifted from the upper level basket insert support structures S and then are inserted from the front of the frame F beneath the handle 245 and slid along on the horizontal wire portions or rails 207L of the lower level basket insert support structures S by the user/consumer into the basket receiving areas A1 and A2, respectively, until reaching the "locked in" position on the lower level basket insert support structures S. By sliding the metal wire basket inserts 501 and 502 into position at the lower level L of the modular third, top washware rack 200, the user/consumer can provide more loading capacity in the modular third, top washware rack 200, as there is more vertical distance between the bottom portion 507, 508 of the basket insert and the inner surface of the top wall of the dishwasher compartment 101.

FIGS. 7A to 7E are various views showing a pair of plastic silverware basket inserts 601 and 602 used in place of the metal wire basket inserts 501 and 502 in an asymmetrical configuration according to an exemplary embodiment consistent with the present disclosure. In particular, FIG. 7A shows the pair of plastic silverware basket inserts 601 and 602 fully inserted at the upper level U. Each of the plastic silverware basket inserts 601 and 602 can have various utensil holders UTH in the form of tines, prongs, and projections of various shapes. FIG. 7A also shows the front wall 201 of the frame F with the handle 245 removed. FIGS. 7B and 7C show the right side plastic silverware basket insert 602 being inserted from above into the basket receiving area A2, whereas FIGS. 7D and 7E show the right side plastic silverware basket insert 602 being slid along the lower level basket insert support structures S into the basket receiving area A2 at the lower level L. As best shown in FIG. 7D, the plastic silverware basket inserts 601 and 602 can have ridges 605 at the front and rear at each edge that rest within the rails of the support structures S and serve as a locking feature. Also, while the basket insert 602 is shown being slid to the lower level L in basket receiving area A2 in FIG. 7D, the basket insert 602 can also be slid under the basket 601 in basket receiving area A1 in a stackable fashion, since the recess or indent 210 (see FIG. 7A) in the rear wall is only at the upper level U of the upper basket insert receiving areas A1 and A2.

FIG. 8 is a top, front perspective view of the third, top washware rack 200 with a plastic silverware insert 701 shown at an upper level U and a metal wire basket insert 702 shown at a lower level L in an asymmetrical configuration according to an exemplary embodiment consistent with the present disclosure. FIG. 8 also shows an alternative configuration for the handle of the third, top washware rack 200 wherein the handle 245M is elongated to extend over substantially the entire front wall 201M of the modified frame FM.

FIG. 9 is a top, front, perspective view of the third, top washware rack 200' with a wire basket insert 801 and a plastic tray insert 802 of a plastic frame F' and also having two basket insert receiving areas A1' and A2' with different sizes (for example but not limited to, 60 percent on the left side and 40 percent on the right side) so as to accept different sized inserts according to an exemplary embodiment consistent with the present disclosure. In this instance, the different height levels are defined by the designs/geometries of the inserts 801 and 802 themselves. Alternatively, the plastic frame F' can be configured to be disposed over the wire frame F of FIG. 2 or frame F" of FIG. 11A and snap into place thereover and thus use the upper and lower level basket insert support structures S described above. Still further, the upper level basket insert support structures S can be formed by plastic ledges that extend out from the inner side walls of the plastic frame F'. Also, the roller guide systems may be appropriately fastened onto the corresponding side walls 203' of the plastic frame F' (note that only roller guide system G2' disposed on telescopic rail assembly R2' is fully visible in FIG. 9).

Figure 10:
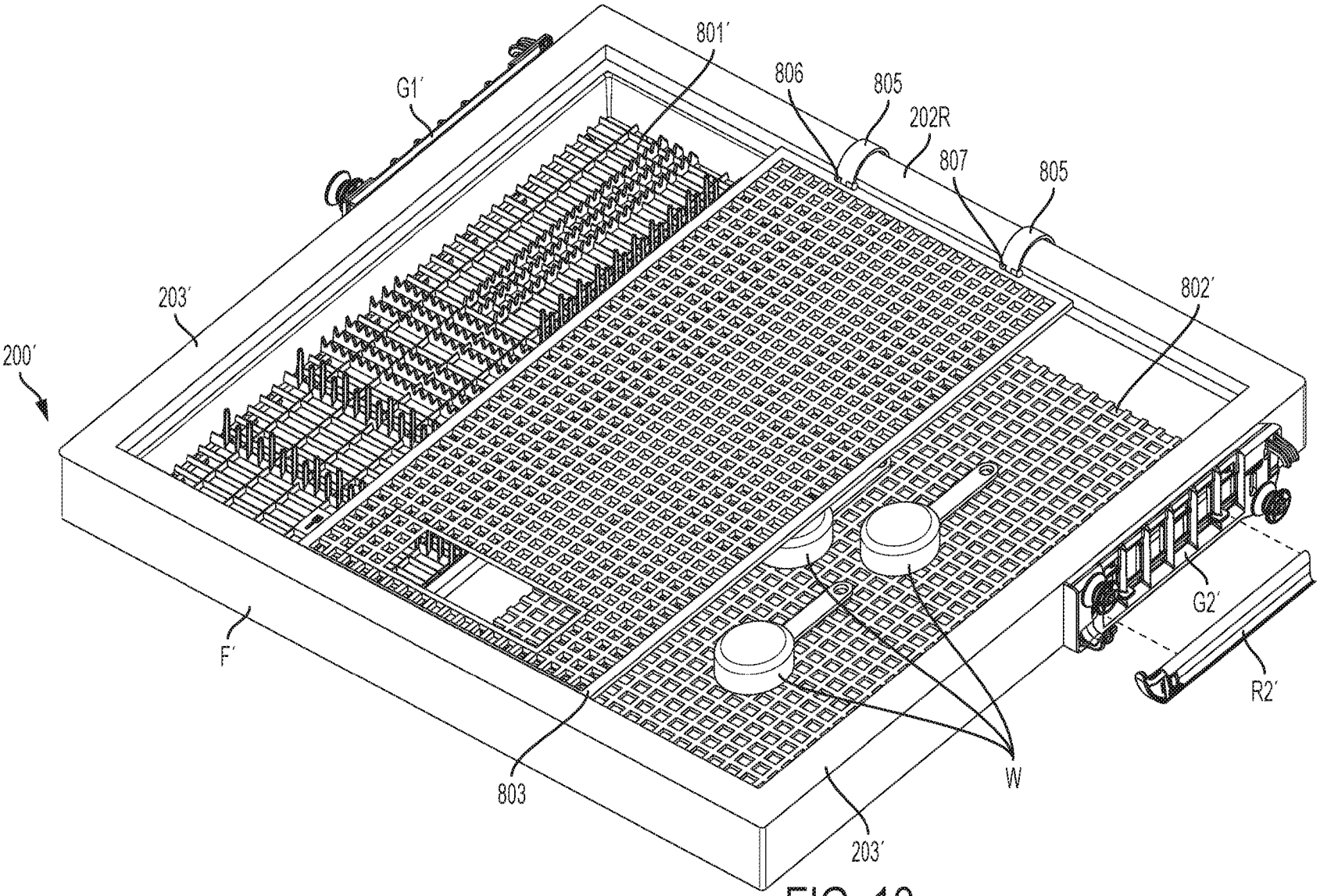
FIG. 10 is a top, front, perspective view of the third, top modular washware rack with the plastic frame of FIG. 9 and having a sliding/hinged lid according to an exemplary embodiment consistent with the present disclosure.

FIG. 10 shows the third, top washware rack 200' with the plastic frame F' of FIG. 9 but with a sliding/hinged lid 803 according to an exemplary embodiment consistent with the present disclosure. The lid 803 is positionable over a corresponding one of the basket inserts 801' and 802' by sliding on top of the upper edges of the basket inserts 801' and 802'. The lid 803 is configured to hold items to be washed W in place within the corresponding one of the basket inserts 801' or 802'. The lid 803 also may have a pair of hinges 804 and 805 at a rear edge thereof, such that the user/consumer can lift the lid 803 from the front and pivot the lid 803 about the hinges 804 and 805 at the rear edge thereof, with the hinges 804 and 805 pivoting about hinge points 806 and 807, respectively, adjacent to the rear wall 202R of the plastic frame F'.

Figure 11A:
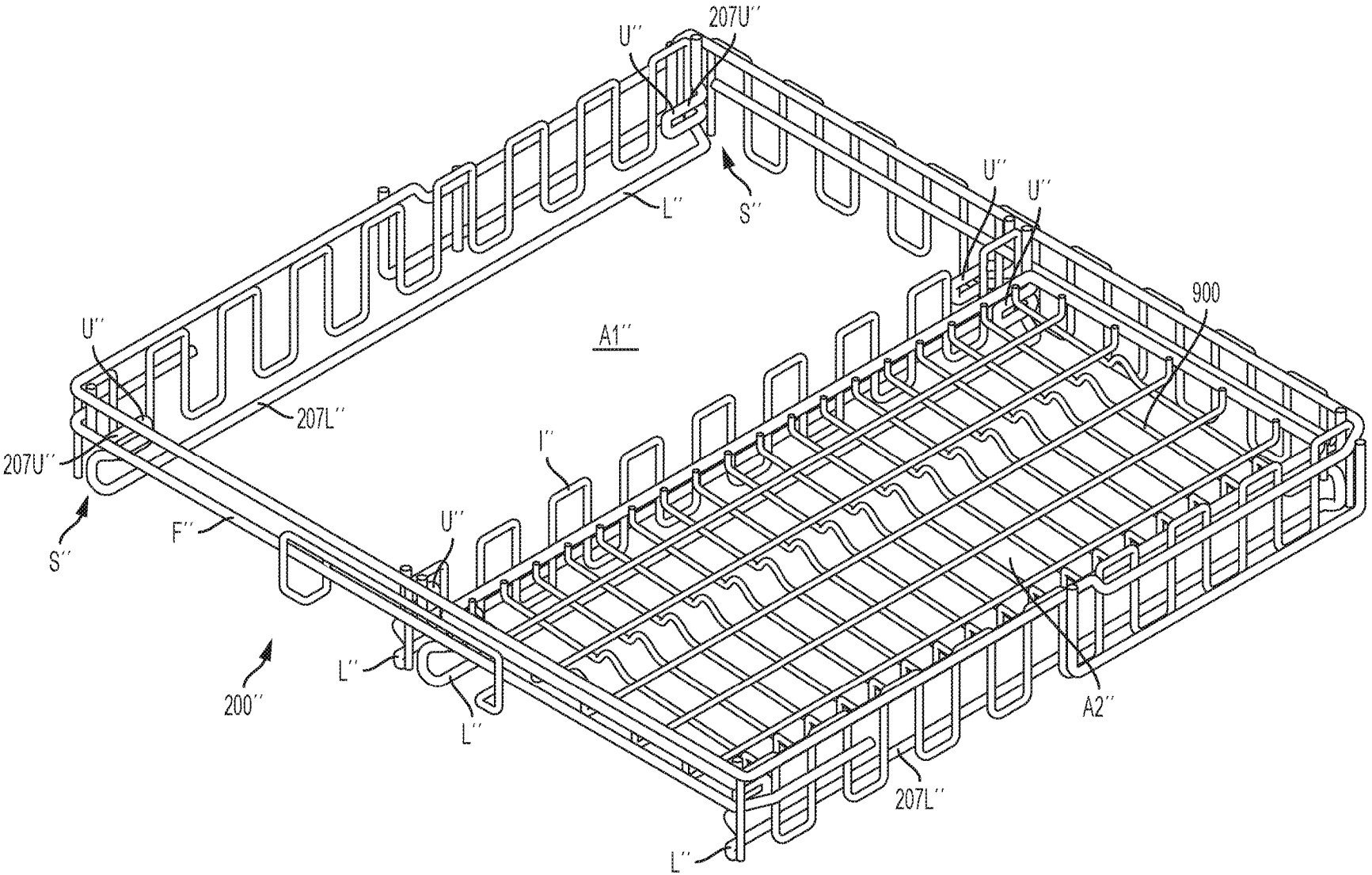
FIG. 11A is a top, front, perspective view of the frame of the third, top washware rack with a metal wire basket insert shown at an upper level in a symmetrical configuration according to an exemplary embodiment consistent with the present disclosure.

FIG. 11A is a top, front, perspective view of the frame F" of the third, top washware rack 200" with a metal wire basket insert 900 shown at an upper level U" in the basket receiving area A2" in a symmetrical configuration according to an exemplary embodiment consistent with the present disclosure. In this symmetrical design, the basket receiving areas A1" and A2" have the same shape (for example, there is no recess or indent 210 in the rear wall 202 as in the asymmetrical embodiments) such that the basket inserts 900 can have a symmetrical outer shape and be received in either basket receiving area A1" and A2" at the upper level U", as well as being slidable into either basket receiving area A1" or A2" at the lower level L".

As shown in FIG. 11A, the upper level basket insert support structures S" are formed by bent wire portions 207U" that are formed into a loop at the front and rear of the frame F" and at the four corners of each basket receiving area A1" and A2". The lower level basket insert support structures S" are formed by a pair of spaced apart rails formed by the horizontal wire portions 207L" at both sides in each basket receiving area A1" and A2". The horizontal wire portions 207L" can be formed as a downward continuation of the loop of the bent wire portions 207U" at the front and rear of the frame F", as shown in FIG. 11A. Although not shown, the symmetrical embodiment of FIG. 11A can use the same type of locking feature 505 that is formed as a slight bend/step at the front and rear of the metal wire basket inserts 900 as used in the asymmetrical embodiment of FIG. 3B.

Figure 11B:
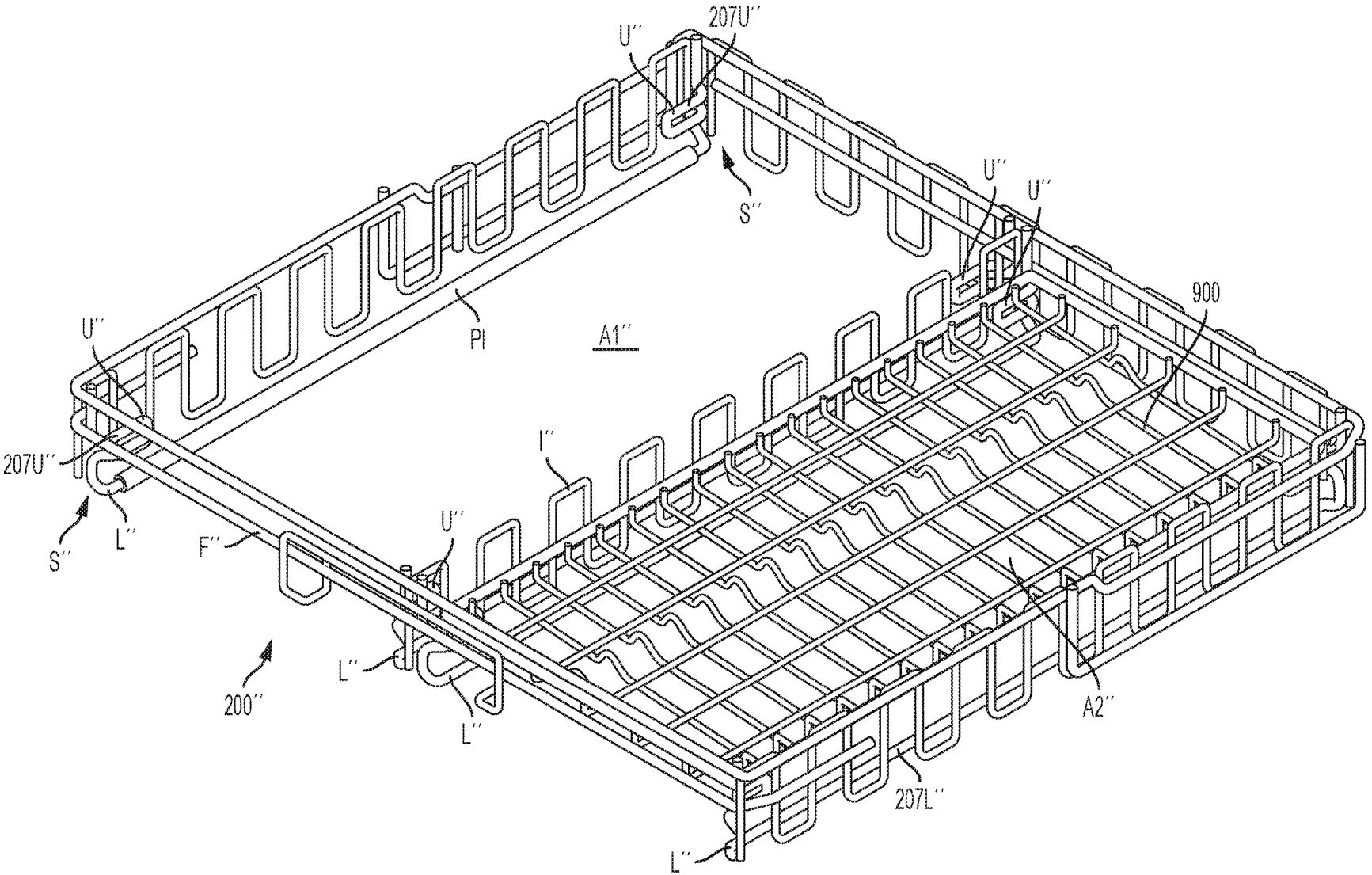
FIGS. 11B and 11C show variations that can be implemented in both the symmetrical and the asymmetrical embodiments.
Figure 11C:
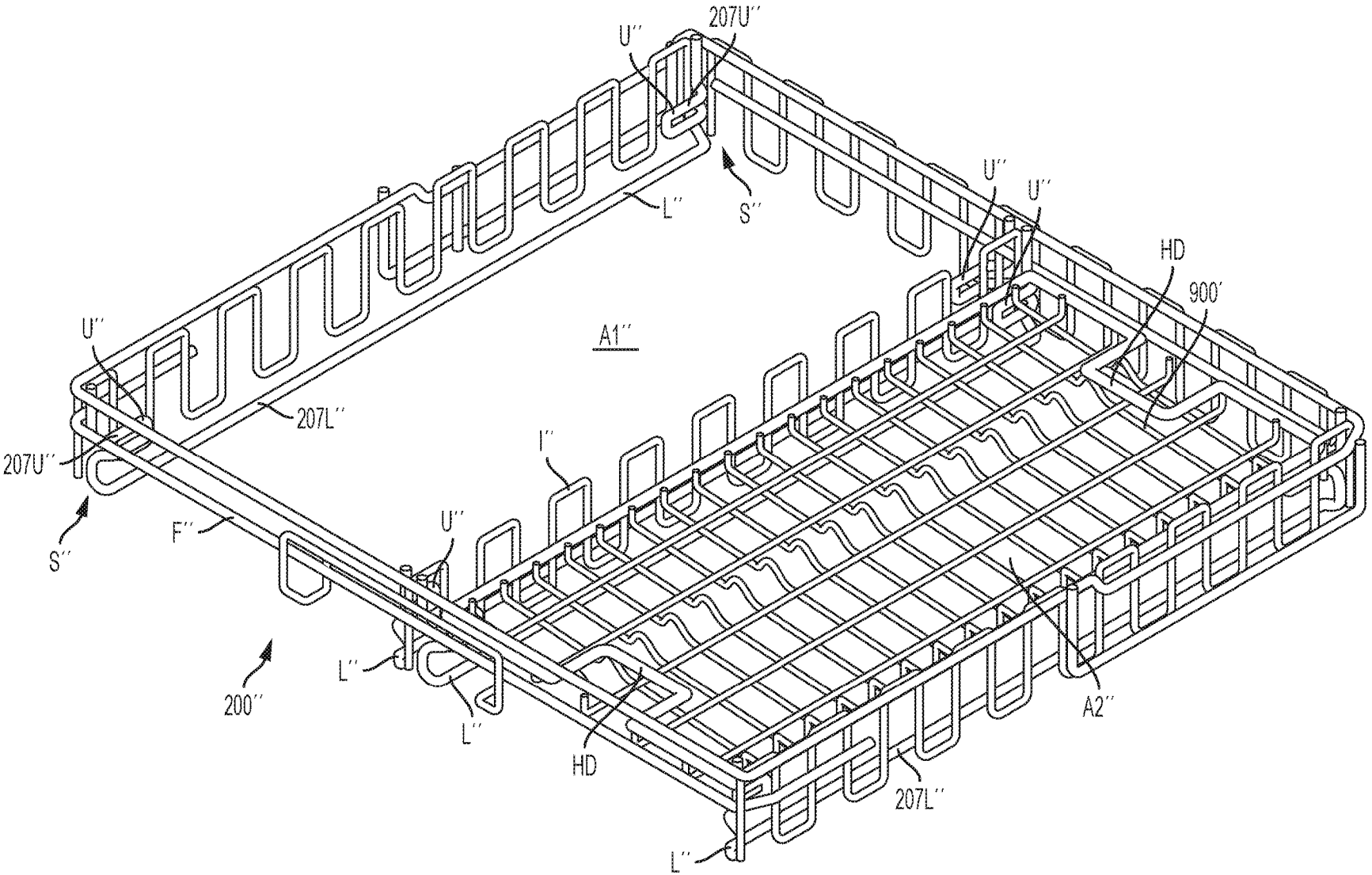

FIGS. 11B and 11C show variations that can be implemented in both the symmetrical and the asymmetrical embodiments. FIG. 11B shows a plastic piece or insert PI that can be disposed over the horizontal wire portions or rails 207L, 207L" of the support structures S, S" in order to prevent metal on metal contact when the metal wire basket insert 900 is slid into position at the lower level L, L". FIG. 11C shows handles HD that can be included on the wire basket insert 900' (or the plastic silverware insert if desired) in order to facilitate lifting of the inserts out of the frame F, F', F" at the upper level U, U".

The present invention has substantial opportunity for variation without departing from the spirit or scope of the present invention. For example, while a plastic silverware insert and a metal wire basket insert are described, other materials can be used for the inserts such as, for example but not limited to, a silicone insert. Further, while two basket inserts are shown side-by-side, the intermediate member can be eliminated in the open frame such that there is a single basket insert receiving area and a single basket insert can extend over the entire width of the open frame. Thus, the single basket insert is adjustable in height by lifting and removing the single basket insert from the upper level of the open frame and then sliding the single basket insert along the rails at the lower level. Also, more than two basket inserts could be used, as well as a plurality of basket insert receiving areas. Moreover, additional or different inserts for various utensils and cutlery may be included in any of the top, middle, or bottom washware racks. Still further, while the present disclosure describes the modular basket inserts being used with a third, top washware rack, it is not limited to such a configuration and could be used in a middle washware rack of a three washware rack configuration. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A modular washware rack for a dishwasher having a dishwasher compartment, comprising:

an open frame having roller guide systems provided on the left and right sides, respectively, of the open frame, each of the roller guide systems configured to engage with a corresponding telescopic rail assembly mounted on left and right sidewalls, respectively, of the dishwasher compartment for displacement of the modular washware rack in a forward direction and a rearward direction in and out of the dishwasher compartment, the open frame having an upper level support structure that is configured to accept at least one basket insert from above and support the at least one basket insert at an upper level, the open frame having a lower level support structure comprising at least a pair of spaced apart rails which are accessed from a front portion of the open frame, the at least one basket insert being adjustable in height by lifting and completely removing the at least one basket insert from the upper level support structure of the open frame and then sliding the at least one basket insert into the front portion of the open frame along the spaced apart rails of the lower level support structure to support the at least one basket at a lower level.

2. The modular washware rack of claim 1, wherein the open frame is divided by an intermediate frame member so as to define two basket insert receiving areas, and wherein the at least one basket insert comprises two basket inserts disposed in the two basket receiving areas, respectively.

3. The modular washware rack of claim 2, wherein the two basket inserts are asymmetrical in outer shape.

4. The modular washware rack of claim 2, wherein the two basket inserts are symmetrical in outer shape.

5. The modular washware rack of claim 2, wherein the two basket insert receiving areas have different sizes so as to accept different sized basket inserts.

6. The modular washware rack of claim 2, further comprising a slidable lid disposed on upper edges of the basket inserts and positionable over a corresponding one of the basket inserts and configured to hold items to be washed in place within the corresponding one of the basket inserts.

7. The modular washware rack of claim 1, wherein the open frame is formed of a metal wire frame.

8. The modular washware rack of claim 1, wherein the open frame is formed of a plastic frame.

9. The modular washware rack of claim 1, wherein each one of the spaced apart rails includes a plastic insert disposed thereover.

10. The modular washware rack of claim 1, wherein the upper level support structure comprises at least a pair of spaced apart rails.

11. The modular washware rack of claim 1, wherein the at least one basket insert includes handles.

12. A dishwasher, comprising:

a dishwashing compartment having a loading opening;

a door configured to close the loading opening;

a bottom washware rack configured for movement out of and into the dishwashing compartment;

a middle washware rack configured for movement out of and into the dishwashing compartment; and a top washware rack configured for movement out of and into the dishwashing compartment, wherein the top washware rack comprises an open frame having roller guide systems provided on the left and right sides, respectively, of the open frame, each of the roller guide systems configured to engage with a corresponding telescopic rail assembly mounted on left and right sidewalls, respectively, of the dishwashing compartment for displacement of the top washware rack in a forward direction and a rearward direction in and out of the dishwashing compartment, the open frame having an upper level support structure that is configured to accept at least one basket insert from above and support the at least one basket insert at an upper level, the open frame having a lower level support structure comprising at least a pair of spaced apart rails which are accessed from a front portion of the open frame, the at least one basket insert being adjustable in height by lifting and completely removing the at least one basket insert from the upper level support structure of the open frame and then sliding the at least one basket insert into the front portion of the open frame along the spaced apart rails of the lower level support structure to support the at least one basket at a lower level.

13. The dishwasher of claim 12, wherein the open frame is divided by an intermediate frame member so as to define two basket insert receiving areas, and wherein the at least one basket insert comprises two basket inserts disposed in the two basket receiving areas, respectively.

14. The dishwasher of claim 13, wherein the two basket inserts are asymmetrical in outer shape.

15. The dishwasher of claim 13 wherein the two basket inserts are symmetrical in outer shape.

16. The dishwasher of claim 13, wherein the two basket insert receiving areas have different sizes so as to accept different sized basket inserts.

17. The dishwasher of claim 13, further comprising a slidable lid disposed on upper edges of the basket inserts and positionable over a corresponding one of the basket inserts and configured to hold items to be washed in place within the corresponding one of the basket inserts.

18. The dishwasher of claim 12, wherein the open frame is formed of a metal wire frame.

19. The dishwasher of claim 12, wherein the open frame is formed of a plastic frame.

20. The dishwasher of claim 12 wherein the upper level support structure comprises at least a pair of spaced apart rails.

21. A dishwasher comprising a dishwashing compartment, a first, bottom washware rack, a second, middle washware rack, and a third, top washware rack, wherein the third, top washware rack comprises an open frame having roller guide systems provided on the left and right sides, respectively, of the open frame, each of the roller guide systems configured to engage with a corresponding telescopic rail assembly mounted on left and right sidewalls, respectively, of the dishwashing compartment for displacement of the third, top washware rack in a forward direction and a rearward direction in and out of the dishwashing compartment, the open frame having an upper level support structure that is configured to accept at least one basket insert from above and support the at least one basket insert at an upper level, the open frame having a lower level support structure comprising at least a pair of spaced apart rails which are accessed from a front portion of the open frame, the at least one basket insert being adjustable in height by lifting and completely removing the at least one basket insert from the upper level support structure of the open frame and then sliding the at least one basket insert into the front portion of the open frame along the spaced apart rails of the lower level support structure to support the at least one basket at a lower level.

22. The dishwasher of claim 21, wherein the open frame is divided by an intermediate frame member so as to define two basket insert receiving areas, and wherein the at least one basket insert comprises two basket inserts disposed in the two basket receiving areas, respectively.

23. The dishwasher of claim 22, wherein the two basket inserts are asymmetrical in outer shape.

24. The dishwasher of claim 22, wherein the two basket inserts are symmetrical in outer shape.

* * * * *